US008851033B2

(12) United States Patent
Janitschek et al.

(10) Patent No.: US 8,851,033 B2
(45) Date of Patent: Oct. 7, 2014

(54) SPRING SUSPENSION OF A HYDRAULIC CAMSHAFT ADJUSTER

(71) Applicant: Schaeffler Technologies AG & Co. KG, Herzogenaurach (DE)

(72) Inventors: Josef Janitschek, Burgbernheim (DE); Juergen Weber, Erlangen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 13/859,221

(22) Filed: Apr. 9, 2013

(65) Prior Publication Data

US 2013/0276733 A1 Oct. 24, 2013

(30) Foreign Application Priority Data

Apr. 20, 2012 (DE) ..... 10 2012 206 567

(51) Int. Cl.
*F01L 1/34* (2006.01)
*F01L 1/344* (2006.01)

(52) U.S. Cl.
CPC ..... *F01L 1/3442* (2013.01); *F01L 2001/34483* (2013.01)
USPC ..... 123/90.17; 123/90.15

(58) Field of Classification Search
USPC ..... 123/90.15, 90.17, 90.31
See application file for complete search history.

(56) References Cited

U.S. PATENT DOCUMENTS

| | | | | |
|---|---|---|---|---|
| 6,276,321 | B1 | 8/2001 | Lichti et al. | |
| 7,004,129 | B2 | 2/2006 | Schneider | |
| 7,363,897 | B2 * | 4/2008 | Fischer et al. | 123/90.17 |
| 7,503,294 | B2 | 3/2009 | Ogawa et al. | |
| 2010/0154732 | A1 | 6/2010 | Bayrakdar | |

FOREIGN PATENT DOCUMENTS

| | | | |
|---|---|---|---|
| DE | 102006002993 | | 8/2007 |
| DE | 10351223 | B4 | 2/2010 |
| EP | 1365112 | A2 | 11/2003 |

* cited by examiner

*Primary Examiner* — Zelalem Eshete
(74) *Attorney, Agent, or Firm* — Davidson, Davidson & Kappel, LLC

(57) ABSTRACT

A hydraulic camshaft adjuster (1) having a rotor (2) and a stator (3) as well as a cover (4) which is situated in a rotatably fixed manner on the stator (3) and is separate from the stator (3), having a spring (11) designed as a spiral spring (10), the spiral spring (10) having an inner, first end (9) which is fixed on the rotor (2) in a form-locked manner and an outer, free end (13) which is fixed on the cover (4) in a form-locked manner, the second end (13) of the spiral spring (10) being located in a groove (17) present in the cover (4), the groove (17) extending in such a way that the second end (13) of the spiral spring (10) extends from a side of the cover (4) facing away from the stator (3) to a side of the cover (4) facing the stator (3).

15 Claims, 5 Drawing Sheets

SPRING SUSPENSION OF A HYDRAULIC CAMSHAFT ADJUSTER

This claims the benefit of German Patent Application DE 10 2012 206 567.9, filed Apr. 20, 2012 and hereby incorporated by reference herein.

The present invention relates to a hydraulic camshaft adjuster having a rotor and a stator as well as a cover which is situated in a rotatably fixed manner on the stator and is separate from the stator, having a spring designed as a spiral spring, the spiral spring having an inner, first end which is fixed on the rotor in a form-locked manner and an outer, second end which is fixed on the cover in a form-locked manner, the second end of the spiral spring being located in a groove present in the cover.

BACKGROUND

Camshaft adjusters, in particular hydraulic camshaft adjusters, are already known from the prior art, e.g., U.S. Pat. No. 6,276,321 B1.

In modern internal combustion engines, such devices are used to variably set the control times of gas exchange valves to be able to variably create a phase relation between crankshaft and camshaft in a defined angle range, between a maximum early and a maximum late position. For this purpose, the camshaft adjuster is integrated into a drive train via which the torque is transferred from the crankshaft to the camshaft. This drive train may have a traction means such as a belt drive or a chain drive. A gear drive may also be used here.

A camshaft adjuster is known from the prior art which uses a spiral spring, the spiral spring having a radially protruding section, inserted in a groove, which is located on the inner side of a cover. In this respect, reference is again made to U.S. Pat. No. 6,276,321 B1.

Camshaft adjusters having coil springs are also known from U.S. Pat. No. 7,503,294 B2 and EP 1 365 112 A2.

A very failure-proof camshaft adjuster configuration for internal combustion engines is also known from DE 10 2006 002 993 A1, the spiral spring used there being, however, kept in place via protrusions and pins.

The approach known from DE 103 51 223 B4 also relies on a spiral spring meshing with a protrusion of a counter form-locking element which is used separately from the stator and the cover.

In the known approaches, such as the implementation of a spring suspension on pins of M6 screws or rotor pins, for example, additional components are necessary. Unfortunately, a complicated assembly often results, which is due to an axial stripping of the pre-tensioned spring during the assembly, and there is a high risk of wear.

SUMMARY OF THE INVENTION

It is an object of the present invention to provide a hydraulic camshaft adjuster which is cost-effectively manufacturable and robust and which has a durable spring suspension, with the aid of which the assembly of a restoring spring is easily possible.

The present invention provides a generic hydraulic camshaft adjuster in that the groove extends in such a way that the second end of the spiral spring extends from a side of the cover facing away from the stator to a side of the cover facing the stator.

The spring thus completely penetrates the cover. The stripping, which is otherwise very common in spiral springs after achieving the pre-tensioning, may thus be avoided. An additional fixing in the form of a spring cover may be dispensed with. A particularly robust suspension of the restoring spring is implemented. The assembly is simplified.

It can be advantageous when the groove is aligned in parallel or obliquely to the axial direction of the camshaft adjuster and is preferably present on the peripheral surface of the cover. When positioning the groove on the peripheral surface, the spring is accessible particularly well and almost the entire diameter area of the cover may be used by the spring to generate a restoring force. In this way, particularly strong restoring forces may be implemented. The manufacture of a groove which is aligned in parallel to the axial direction of the camshaft adjuster is particularly cost-effective, whereas a groove which is aligned obliquely to the axial direction has advantages with regard to the durability of the spring.

The spring is particularly durable when the groove is tilted between 40° and 50°, preferably 45°, toward the axial direction in the peripheral direction. In this way, it is not necessary to bend the spring by 90°; this type of bending would otherwise increase the risk of breakage.

One advantageous exemplary embodiment is also characterized in that the groove transitions into a pocket which is aligned in the peripheral direction and in which a bent flange of the second end of the spiral spring is located. An axial safeguard is implemented in that the flange of the spiral spring meshes with the pocket to generate a form-locked connection via an undercut.

When the pocket is formed by a recess located in the stator and/or in the cover, it is possible to use the installation space available for the camshaft adjuster in a particularly efficient manner. It is particularly advantageous when the stator has the pocket, since in this case the axial length of the camshaft adjuster may be particularly small and the pocket is easily formable. This pocket in the stator may be manufactured particularly easily due to the fact that the stator is usually made of sinter material and the pocket may be easily provided during the construction of the stator.

To ensure a particularly good functionality, it is advantageous when the recesses in the stator and the recesses in the rotor are flush in order to form the pocket. One advantageous variant is also characterized in that one half of the pocket is located in the stator and the other half of the pocket is located in the cover.

The adjustment of the spring to the groove, while reducing the risk of breakage, is particularly good when the second end of the spiral spring is bent in the axial direction at least once, preferably bent by 42°.

It is also advantageous when the flange is located in a plane which is aligned orthogonally to the axial direction and which is offset in the axial direction to a spring plane largely accommodating the spiral spring. Except for the second end, the spiral spring is thus located in a first spring plane, an axial safeguard being ensured by the flange which is situated in a plane running in parallel thereto and which is in retained operative contact with the material of the cover.

The variability of the camshaft adjuster may be increased when the cover is fastened, preferably screwed, to the stator and/or to a gear wheel, the stator being connected in one piece to the gear wheel or being screwed to one or both components in the case of an at least two-part configuration of stator and gear wheel. The use of screws is advantageous, in particular, since they may be installed particularly rapidly and efficiently. It is to be pointed out that the stator may, in principle, also have an elongated hole in which the appropriate screw is located. The elongated hole could also have a bent shape, e.g., the shape of a banana, the common circular shape, however, being a more cost-effective and more rapidly introducible variant.

It is also advantageous when an axially protruding deflection pin, around which the spiral spring is deflected, is situated on the cover.

BRIEF DESCRIPTION OF THE DRAWINGS

The present invention is also explained in greater detail with the aid of a drawing in which three exemplary embodiments are illustrated.

DETAILED DESCRIPTION

Figure 1:
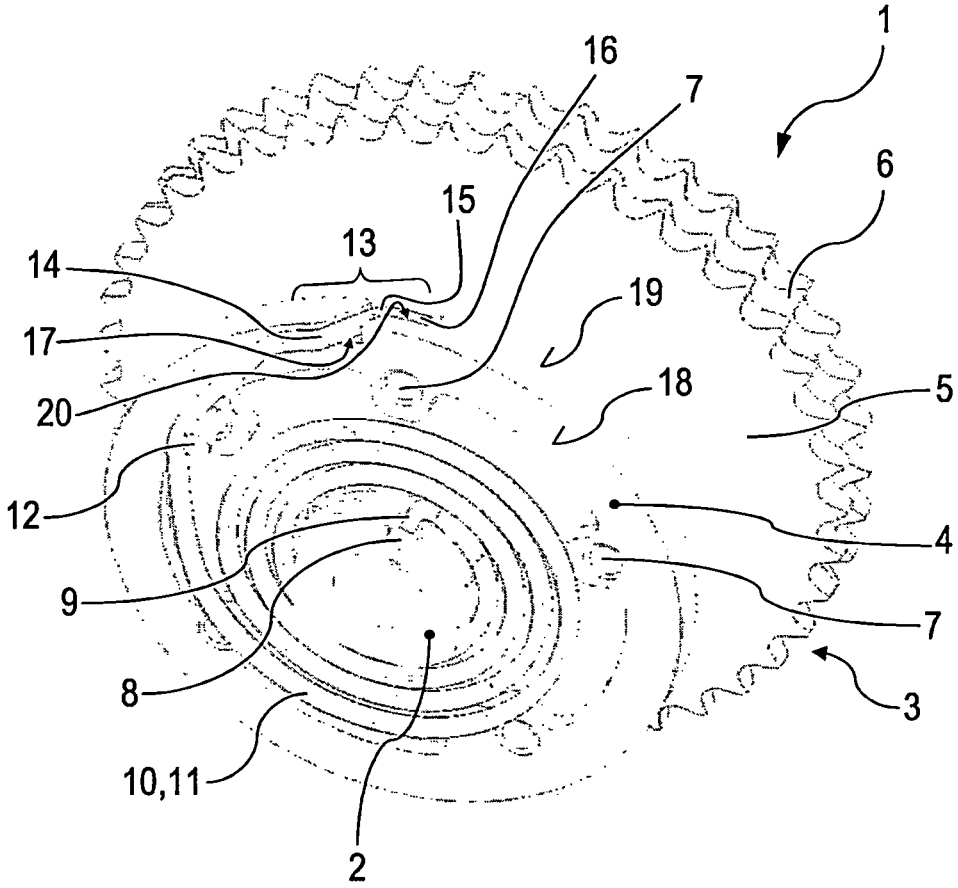
FIG. 1 shows a first exemplary embodiment of a camshaft adjuster according to the present invention, a pocket accommodating a flange of a spiral spring being completely located in the cover.

The figures are only schematic and are used for the sake of understanding the present invention. Identical elements are provided with identical reference numerals.

A first specific embodiment of a camshaft adjuster 1 according to the present invention is illustrated in FIG. 1. Camshaft adjuster 1 has a rotor 2 and a stator 3. A cover 4 is attached to stator 3.

Stator 3 is connected to a gear wheel 5. The gear wheel having a toothing 6 is designed to have a traction means, such as a chain, for establishing contact. However, a belt may also be used in the case of an appropriate selection of toothing 6.

Stator 3 and gear wheel 5 may also be designed as an equilateral component. Cover 4 is fastened to the stator via fastening means, for example screws 7 in the present case. Gear wheel 5 may also be fastened to stator 3 and cover 4 via the same screws 7 or via separate screws 7.

An indent 8, in which a first end 9 of a spring 11, designed as spiral spring 10, is located in a form-locked manner on the outer side of rotor 2.

Spiral spring 10 is essentially located in a plane and surrounds rotor 2 in a spiral-shaped manner. It is radially slightly deflected in this plane at a deflection pin 12. Radially further outside of deflection pin 12, spiral spring 10 has a second end 13. On second end 13, spiral spring 10 is axially bent to the outside by 45° at a first deflection point 14 and it is bent in the opposite direction in the peripheral direction at a second deflection point 15. A flange 16 is formed by the bending at second deflection point 15. Flange 16 is located in a plane which is aligned orthogonally to the axial direction and which is situated in parallel to the plane accommodating the predominant rest of spiral spring 10.

Second end 13 is located in a groove 17 in cover 4, spring 11 extending from a first side 18 to a second side 19 of cover 4. Second side 19 of cover 4 is in contact with stator 3. Second end 13 of spiral spring 10 thus completely penetrates this cover 4 close to the largest radial extension of cover 4.

Flange 16 of spiral spring 10 is located in a pocket 20 in this case.

Figure 2:
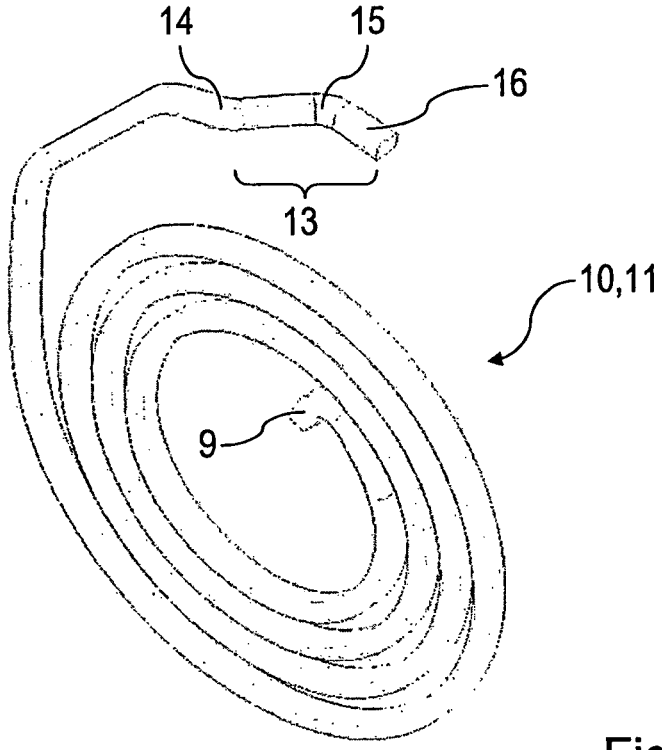
FIG. 2 shows a first perspective illustration of the spiral spring used in the exemplary embodiment illustrated in FIG. 1.
Figure 3:
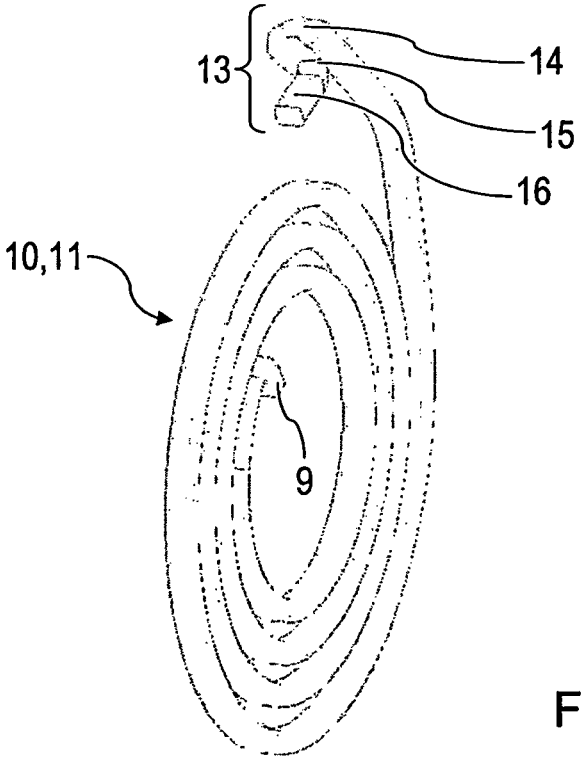
FIG. 3 shows a second perspective illustration of the spiral spring illustrated in FIG. 2.

In FIGS. 2 and 3, the spiral spring is illustrated in two different perspective views in order to be able to better capture the spatial characteristic of the spring.

Figure 4:
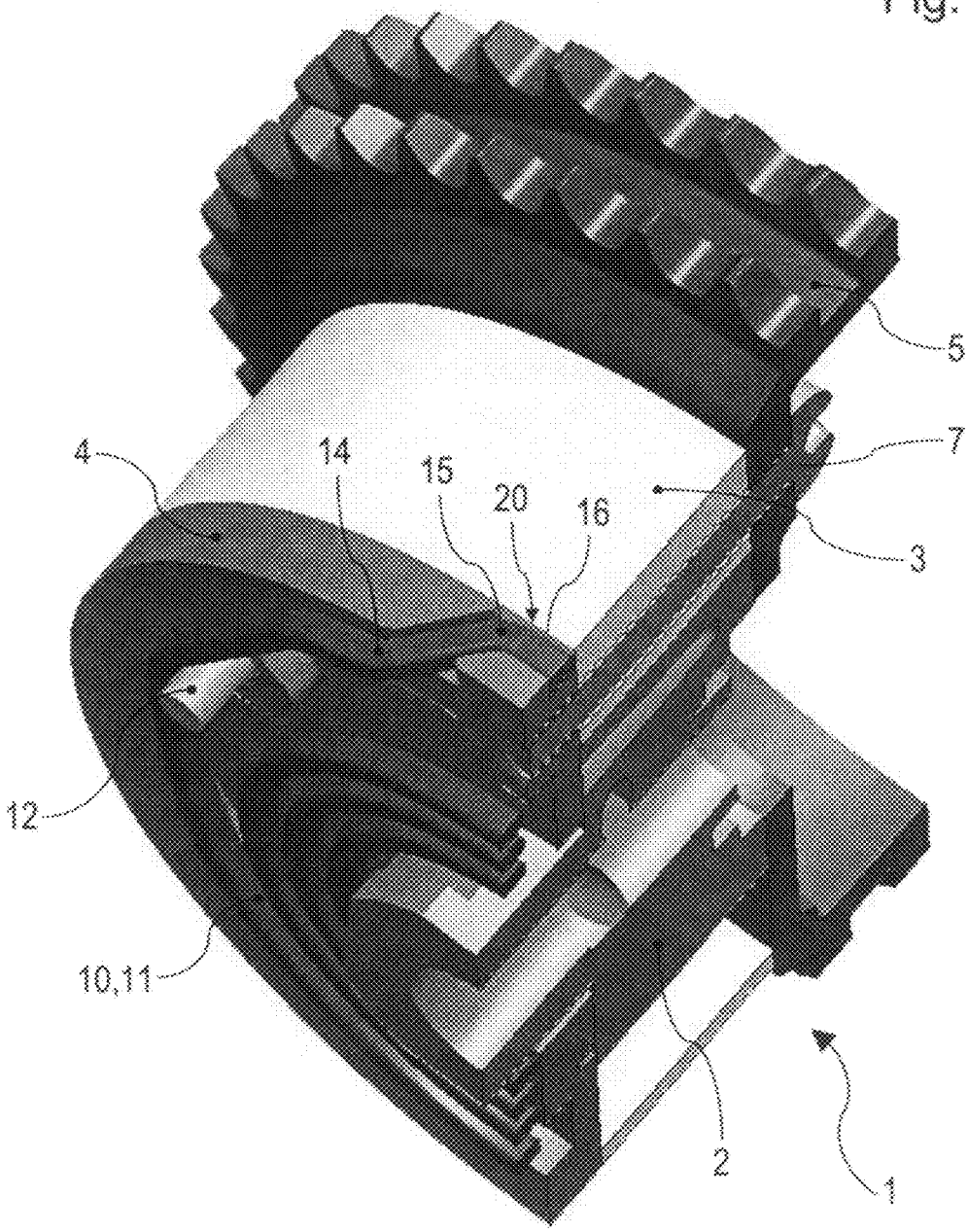
FIG. 4 shows a perspective illustration of the exemplary embodiment from FIG. 1 in a partial sectional view.

The variant is visualized once again in FIG. 4 in a sectional view to show that screw 7 completely penetrates gear wheel 5, stator 3, and cover 4, a screw head of screw 7 being located on the side of gear wheel 5.

Figure 5:
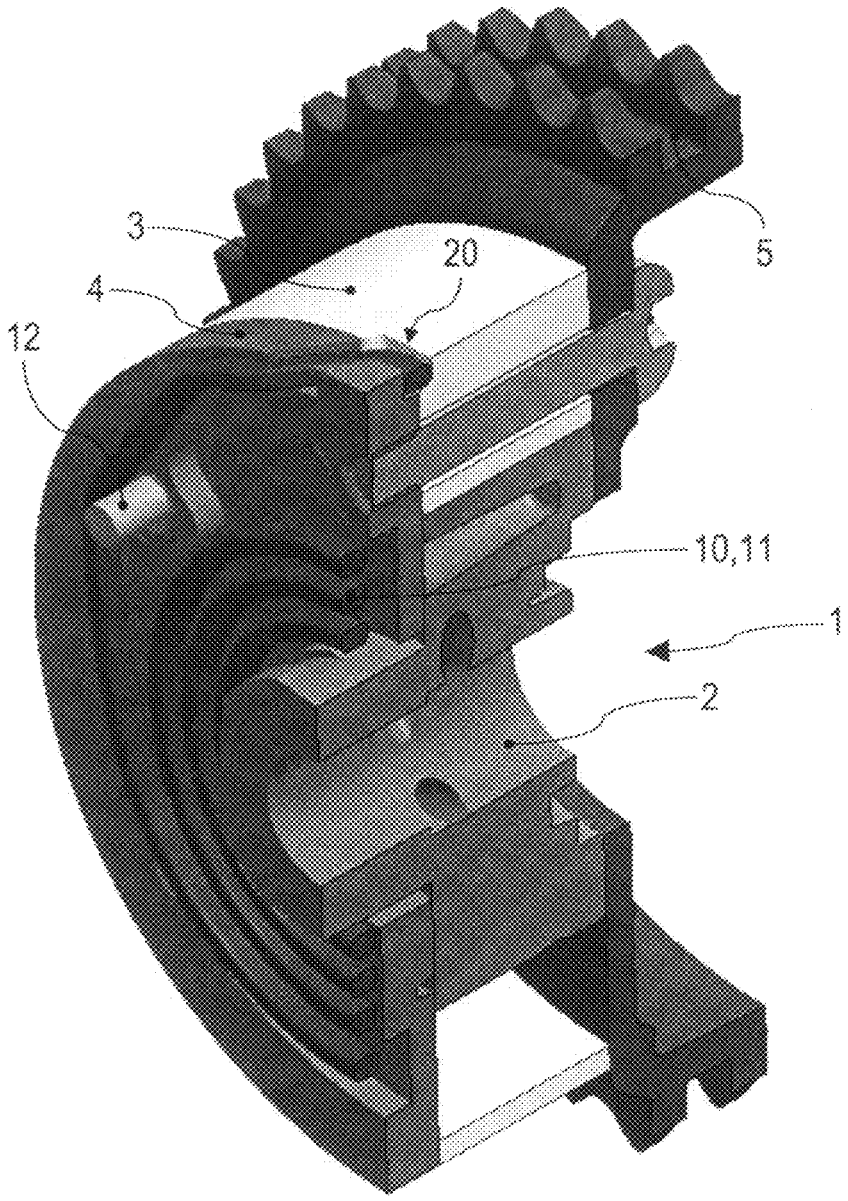
FIG. 5 shows a second exemplary embodiment of a camshaft adjuster, one half of the pocket accommodating the flange on the second end of the spiral spring being formed, with regard to its volume, by the cover and the other half by the stator.

Pocket 20 is formed completely in cover 4 and defined by the material of cover 4 and the material of stator 3. In the exemplary embodiment according to FIG. 5, one half of pocket 20 is located, with regard to its volume, in cover 4 and the other half is located, with regard to its volume, in stator 3.

Figure 6:
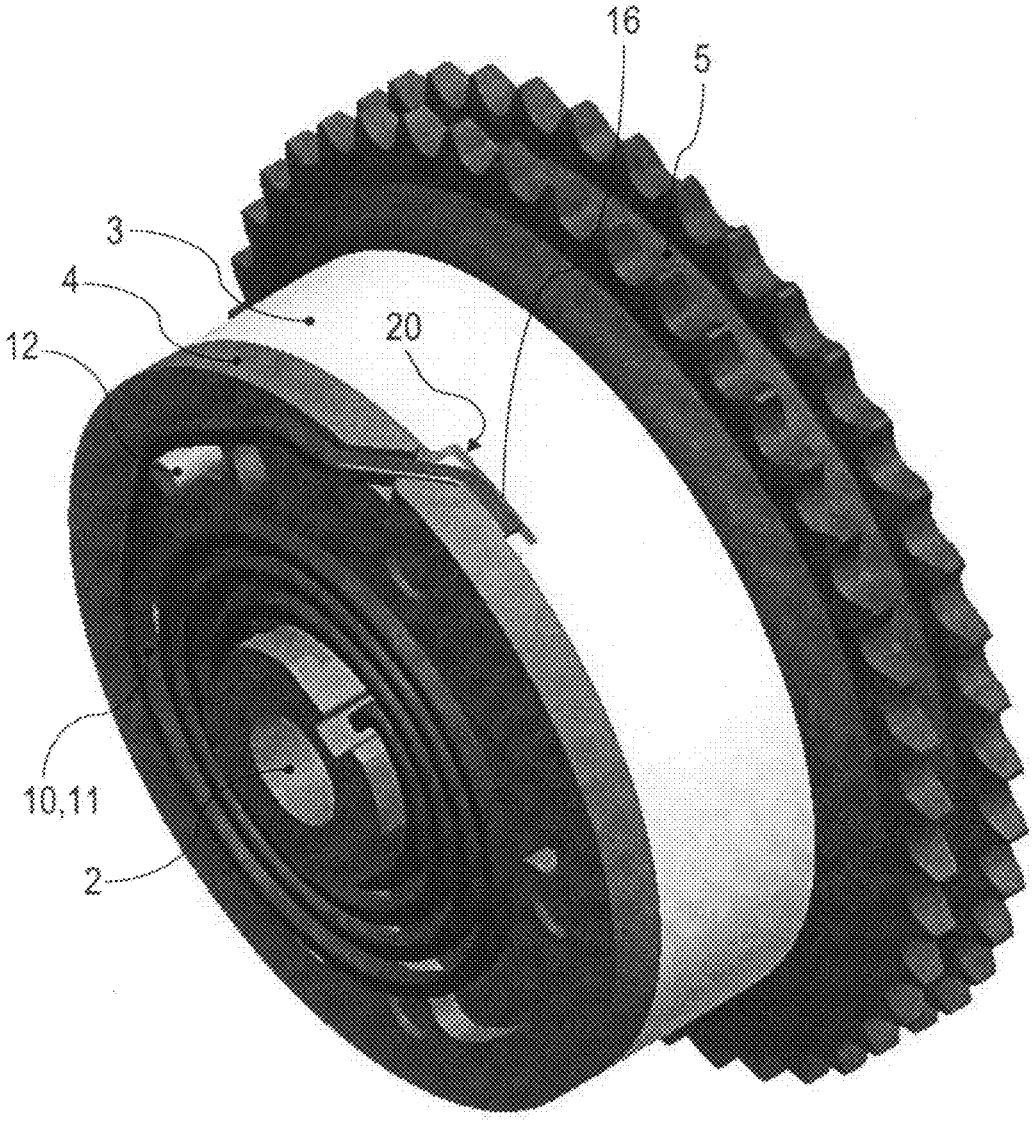
FIG. 6 shows a third exemplary embodiment of a camshaft adjuster according to the present invention, the flange being accommodated on the second end of the spiral spring in a pocket which is entirely formed by the stator.

In the exemplary embodiment according to FIG. 6, pocket 20 is formed entirely in stator 3, with regard to its volume, so that flange 16 on second end 13 of spiral spring 10 is exclusively present there.

LIST OF REFERENCE NUMERALS

1 camshaft adjuster
2 rotor
3 stator
4 cover
5 gear wheel
6 toothing
7 screw
8 indent
9 first end
10 spiral spring
11 spring
12 deflection pin
13 second end
14 first deflection point
15 second deflection point
16 flange
17 groove
18 first side
19 second side
20 pocket

What is claimed is:

1. A hydraulic camshaft adjuster comprising;

a rotor;

a stator;

a cover situated in a rotatably fixed manner on the stator and separate from the stator; and a spiral spring having an inner, first end fixed on the rotor in a form-locked manner and an outer, free end fixed on the cover in a form-locked manner, the second end of the spiral spring being located in a groove present in the cover, the groove extends in such a way that the second end of the spiral spring extends from a side of the cover facing away from the stator to a side of the cover facing the stator.

2. The hydraulic camshaft adjuster as recited in claim 1 wherein the groove is aligned in parallel or obliquely to the axial direction of the camshaft adjuster.

3. The hydraulic camshaft adjuster as recited in claim 2 wherein the groove is on the peripheral surface of the cover.

4. The hydraulic camshaft adjuster as recited in claim 3 wherein the groove is tilted between 40° and 50° toward the axial direction in the peripheral direction.

5. The hydraulic camshaft adjuster as recited in claim 4 wherein the grooves is tilted 45°.

6. The hydraulic camshaft adjuster as recited in claim 1 wherein the groove transitions into a pocket aligned in the peripheral direction and in which a bent flange of the second end of the spiral spring is located.

7. The hydraulic camshaft adjuster as recited in claim 6 wherein the pocket is formed by a recess located in the stator and/or in the cover.

8. The hydraulic camshaft adjuster as recited in claim 7 wherein the recess in the stator and a further recess in the rotor are flush in order to form the pocket.

9. The hydraulic camshaft adjuster as recited in claim 8 wherein one half of the pocket is located in the stator and the other half of the pocket is located in the cover.

10. The hydraulic camshaft adjuster as recited in claim 1 wherein the second end of the spiral spring is bent in the axial direction at least once.

11. The hydraulic camshaft adjuster as recited in claim 10 wherein the second end is bent in the axial direction by 45°.

12. The hydraulic camshaft adjuster as recited in claim 6 wherein the flange is located in a plane aligned orthogonally to the axial direction and offset in the axial direction to a spring plane accommodating the spiral spring.

13. The hydraulic camshaft adjuster as recited in claim 1 wherein the cover is fastened to the stator and/or to a gear wheel, the stator being connected in one piece to the gear wheel or being screwed to one or both components in the case of an at least two-part configuration of stator and gear wheel.

14. The hydraulic camshaft adjuster as recited in claim 13 wherein the cover is screwed to the stator and/or to a gear wheel.

15. The hydraulic camshaft adjuster as recited in claim 1 further comprising an axially protruding deflection pin, around which the spiral spring is deflected, is situated on the cover.

* * * * *